US011213064B2

(12) United States Patent
Roudier et al.

(10) Patent No.: US 11,213,064 B2
(45) Date of Patent: Jan. 4, 2022

(54) MULTILAYER COMBUSTIBLE HEAT SOURCE

(71) Applicant: Philip Morris Products S.A., Neuchatel (CH)

(72) Inventors: Stephane Roudier, Colombier (CH); Frank Joerg Clemens, Frauenfeld (CH); Marina Ismael Michen, Naenikon (CH)

(73) Assignee: Philip Morris Products S.A., Neuchatel (CH)

( * ) Notice: Subject to any disclaimer, the term of this patent is extended or adjusted under 35 U.S.C. 154(b) by 1044 days.

(21) Appl. No.: 14/380,456

(22) PCT Filed: Feb. 21, 2013

(86) PCT No.: PCT/EP2013/053460
§ 371 (c)(1),
(2) Date: Aug. 22, 2014

(87) PCT Pub. No.: WO2013/124357
PCT Pub. Date: Aug. 29, 2013

(65) Prior Publication Data

US 2015/0007837 A1 Jan. 8, 2015

(30) Foreign Application Priority Data

Feb. 24, 2012 (EP) ..... 12156969

(51) Int. Cl.
*A24D 1/22* (2020.01)
*A24B 15/16* (2020.01)

(52) U.S. Cl.
CPC ..... *A24D 1/22* (2020.01); *A24B 15/165* (2013.01); *Y10T 428/24992* (2015.01)

(58) Field of Classification Search
None
See application file for complete search history.

(56) References Cited

U.S. PATENT DOCUMENTS 1,529,181 A * 3/1925 Holmes ..... A24D 1/08 131/351
1,629,181 A * 5/1927 Holmes ..... A01D 75/04 56/480

(Continued)

FOREIGN PATENT DOCUMENTS

CN 1043250 A 6/1990
CN 1078621 A 11/1993

(Continued)

OTHER PUBLICATIONS

Office Action dated Jan. 4, 2017 in Japanese Patent Application No. 2014-558100 (with English translation).

(Continued)

*Primary Examiner* — Michael J Felton
(74) *Attorney, Agent, or Firm* — Oblon, McClelland, Maier & Neustadt, L.L.P.

(57) ABSTRACT

A multilayer combustible heat source for a smoking article is provided, including a combustible first layer including carbon; and a second layer in direct contact with the first layer, the second layer including carbon and at least one ignition aid, wherein the combustible first layer and the second layer are longitudinal concentric layers having a density of at least 0.6 g/cm$^3$, and wherein the composition of the first layer is different from the composition of the second layer.

14 Claims, 3 Drawing Sheets

(56) References Cited

U.S. PATENT DOCUMENTS

| | | | | |
|---|---|---|---|---|
| 3,738,374 | A * | 6/1973 | Bennett | A24B 15/165 131/359 |
| 4,771,795 | A | 9/1988 | White et al. | |
| 4,779,631 | A | 10/1988 | Durocher et al. | |
| 5,040,551 | A | 8/1991 | Schlatter et al. | |
| 5,050,621 | A | 9/1991 | Creighton et al. | |
| 5,303,720 | A | 4/1994 | Banerjee et al. | |
| 5,348,027 | A | 9/1994 | Barnes et al. | |

FOREIGN PATENT DOCUMENTS

| | | | |
|---|---|---|---|
| CN | 101778578 | A | 7/2010 |
| CN | 101925309 | A | 12/2010 |
| EP | 0 281 967 | | 9/1988 |
| EP | 0 354 661 | | 2/1990 |
| EP | 0 399 252 | | 11/1990 |
| EP | 0 569 964 | | 11/1993 |
| JP | 62-269676 | A | 11/1987 |
| JP | 2-215373 | A | 8/1990 |
| JP | 3-19684 | A | 1/1991 |
| JP | 2010-535530 | A | 11/2010 |
| JP | 2011-509667 | A | 3/2011 |
| TW | 178514 | | 2/1992 |
| TW | 400217 | | 8/2000 |
| TW | 200938103 | A | 9/2009 |
| TW | 200946041 | A1 | 11/2009 |
| TW | 201134408 | A1 | 10/2011 |
| WO | WO 2009/022232 | A2 | 2/2009 |
| WO | WO 2009/074870 | A2 | 6/2009 |

OTHER PUBLICATIONS

International Search Report dated Apr. 19, 2013 in PCT/EP13/053460 Filed Feb. 21, 2013.

Combined Office Action and Search Report dated Dec. 28, 2015 in Chinese Patent Application No. 201380016398.1 (with English language translation).

Combined Office Action and Search Report dated May 12, 2016 in Taiwanese Patent Application No. 102106354 (with English language translation).

Office Action dated Jun. 13, 2018 in Taiwanese Patent Application No. 107100946, citing document AO therein, 8 pages (with English language translation).

Japanese Office Action dated May 13, 2019 in Patent Application No. 2018-000276, citing documents AO-AP therein, 5 pages (with unedited computer generated English translation).

Korean Office Action dated Dec. 13, 2019 in Patent Application No. 10-2014-7022933 (with English translation), citing document AO therein, 3 pages.

* cited by examiner

MULTILAYER COMBUSTIBLE HEAT SOURCE

CROSS REFERENCE TO RELATED APPLICATION

This application is a national phase application based on PCT/EP2013/053460, filed on Feb. 21, 2013.

The present invention relates to a multilayer combustible heat source for a smoking article and to a smoking article comprising a multilayer combustible heat source.

A number of smoking articles in which tobacco is heated rather than combusted have been proposed in the art. One aim of such 'heated' smoking articles is to reduce known harmful smoke constituents of the type produced by the combustion and pyrolytic degradation of tobacco in conventional cigarettes. In one known type of heated smoking article, an aerosol is generated by the transfer of heat from a combustible heat source to an aerosol-forming substrate located downstream of the combustible heat source. During smoking, volatile compounds are released from the aerosol-forming substrate by heat transfer from the combustible heat source and entrained in air drawn through the smoking article. As the released compounds cool, they condense to form an aerosol that is inhaled by the user.

For example, WO-A2-2009/022232 discloses a smoking article comprising a combustible heat source, an aerosol-forming substrate downstream of the combustible heat source, and a heat-conducting element around and in direct contact with a rear portion of the combustible heat source and an adjacent front portion of the aerosol-forming substrate.

The combustion temperature of a combustible heat source for use in a heated smoking article should not be so high as to result in combustion or thermal degradation of the aerosol forming material during use of the heated smoking article. However, the combustion temperature of the combustible heat source should be sufficiently high to generate enough heat to release sufficient volatile compounds from the aerosol forming material to produce an acceptable aerosol, especially during early puffs.

A combustible heat source for use in a heated smoking article should contain sufficient combustible material to produce an acceptable aerosol, especially during later puffs. However, the combustible heat source should also rapidly reach an appropriate combustion temperature after ignition thereof to avoid a delay between a consumer igniting the combustible heat source and an acceptable aerosol being produced.

One or more ignition aids may be included in a combustible heat source for use in a heated smoking article in order to enhance the ignition and combustion properties of the combustible heat source and so improve the quality of the aerosol produced during early puffs. However, the inclusion of one or more ignition aids decreases the content of combustible material in the combustible heat source and so may adversely affect the quality of the aerosol produced during later puffs.

It would be desirable to provide a combustible heat source for a smoking article that provides an acceptable aerosol during both early puffs and late puffs.

According to the invention there is provided a multilayer combustible heat source for a smoking article comprising: a combustible first layer comprising carbon; and a second layer in direct contact with the first layer, the second layer comprising carbon and at least one ignition aid, wherein the first layer and the second layer are longitudinal concentric layers having an apparent density of at least 0.6 g/cm$^3$ and wherein the composition of the first layer is different from the composition of the second layer.

According to the invention there is also provided a smoking article comprising a multilayer combustible heat source according to the invention; and an aerosol-forming substrate downstream of the multilayer combustible heat source.

As used herein, the term 'direct contact' is used to indicate that the second layer touches the first layer and that there are no intervening layers between the first layer and the second layer.

As used herein, the term 'ignition aid' is used to denote a material that releases one or both of energy and oxygen during ignition of the combustible heat source, where the rate of release of one or both of energy and oxygen by the material is not ambient oxygen diffusion limited. In other words, the rate of release of one or both of energy and oxygen by the material during ignition of the combustible heat source is largely independent of the rate at which ambient oxygen can reach the material. As used herein, the term 'ignition aid' is also used to denote an elemental metal that releases energy during ignition of the combustible heat source, wherein the ignition temperature of the elemental metal is below about 500° C. and the heat of combustion of the elemental metal is at least about 5 kJ/g.

As used herein, the term 'ignition aid' does not include alkali metal salts of carboxylic acids (such as alkali metal citrate salts, alkali metal acetate salts and alkali metal succinate salts), alkali metal halide salts (such as alkali metal chloride salts), alkali metal carbonate salts or alkali metal phosphate salts, which are believed to modify carbon combustion. Even when present in a large amount relative to the total weight of the combustible heat source, such alkali metal burn salts do not release enough energy during ignition of a combustible heat source to produce an acceptable aerosol during early puffs.

As used herein, the term 'aerosol-forming substrate' is used to describe a substrate capable of releasing upon heating volatile compounds, which can form an aerosol. The aerosols generated from aerosol-forming substrates of smoking articles according to the invention may be visible or invisible and may include vapours (for example, fine particles of substances, which are in a gaseous state, that are ordinarily liquid or solid at room temperature) as well as gases and liquid droplets of condensed vapours.

As used herein, the terms 'upstream' and 'front', and 'downstream' and 'rear', are used to describe the relative positions of components, or portions of components, of smoking articles according to the invention in relation to the direction in which a user draws on the smoking articles during use thereof. Smoking articles according to the invention comprise a mouth end and an opposed distal end. In use, a user draws on the mouth end of the smoking articles. The mouth end is downstream of the distal end. The multilayer combustible heat source is located at or proximate to the distal end.

As used herein, the term 'longitudinal layers' is used to refer to layers that meet along an interface that extends along the length of the multilayer combustible heat source.

As used herein, the term 'transverse layers' is used to refer to layers that meet along an interface that extends across the width of the multilayer combustible heat source.

As used herein, the term 'length' is used to describe the dimension in the longitudinal direction of combustible heat sources and smoking articles according to the invention.

As described further below, the inclusion in multilayer combustible heat sources according to the invention of a combustible first layer comprising carbon and a second layer comprising carbon and at least one ignition aid allows different temperature profiles to be provided during early puffs and late puffs of smoking articles according to the invention. This advantageously facilitates production of an acceptable aerosol by smoking articles according to the invention during both early puffs and late puffs.

Flaming and sparkling can be associated with the use of certain ignition aids and other additives in combustible heat sources for smoking articles. As described further below, the inclusion in multilayer combustible heat sources according to the invention of a combustible first layer comprising carbon and a second layer comprising carbon and at least one ignition aid advantageously allows such additives to be located in a position within the multilayer combustible heat source where one or both of the occurrence and visibility of flaming and sparkling is eliminated or reduced.

As described further below, smoking articles according to the invention may comprise multilayer combustible heat sources that are blind or non-blind.

As used herein, the term 'blind' is used to describe a multilayer combustible heat source of a smoking article according to the invention in which air drawn through the smoking article for inhalation by a user does not pass through any airflow channels along the multilayer combustible heat source.

As used herein, the term 'non-blind' is used to describe a multilayer combustible heat source of a smoking article according to the invention in which air drawn through the smoking article for inhalation by a user passes through one or more airflow channels along the multilayer combustible heat source.

As used herein, the term 'airflow channel' is used to describe a channel extending along the length of a multilayer combustible heat source through which air may be drawn downstream for inhalation by a user.

The carbon content of the combustible first layer may be at least about 5 percent by dry weight. For example, the carbon content of the combustible first layer may be at least about 10 percent, at least about 20 percent, at least about 30 percent or at least 40 percent by dry weight.

The combustible first layer preferably has a carbon content of at least about 35 percent, more preferably of at least about 45 percent, most preferably of at least about 55 percent by dry weight. In certain preferred embodiments, the combustible first layer preferably has a carbon content of at least about 65 percent by dry weight.

The second layer comprises carbon and at least one ignition aid.

The carbon content of the combustible first layer is preferably greater than the carbon content of the second layer.

The second layer preferably has a carbon content of less than or equal to about 55 percent, more preferably of less than or equal to about 45 percent, most preferably of less than or equal to about 35 percent by dry weight. In certain preferred embodiments, the second layer preferably has a carbon content of less than about 25 percent by dry weight.

The second layer preferably has an ignition aid content of at least about 35 percent, more preferably of at least about 45 percent, most preferably of at least about 55 percent by dry weight. In certain preferred embodiments, the second layer preferably has an ignition aid content of at least about 65 percent by dry weight.

In certain preferred embodiments, the combustible first layer comprises carbon and at least one ignition aid.

In embodiments where the combustible first layer comprises carbon and at least one ignition aid, the at least one ignition aid in the combustible first layer may be the same as or different from the at least one ignition aid in the second layer.

In embodiments where the combustible first layer comprises carbon and at least one ignition aid, the ignition aid content of the second layer is preferably greater than the ignition aid content of the combustible first layer.

In embodiments where the combustible first layer comprises carbon and at least one ignition aid, the combustible first layer preferably has an ignition aid content of less than or equal to about 60 percent, more preferably of less than or equal to about 50 percent, most preferably of less than or equal to about 40 percent by dry weight. In certain preferred embodiments, the combustible first layer preferably has an ignition aid content of less than or equal to about 30 percent by dry weight.

In certain preferred embodiments, the combustible first layer comprises carbon and at least one ignition aid and the second layer comprises carbon and at least one ignition aid, wherein the ratio by dry weight of carbon to ignition aid in the first layer is different from the ratio by dry weight of carbon to ignition aid in the second layer.

In one particularly preferred embodiment, the combustible first layer comprises carbon and at least one ignition aid and the second layer comprises carbon and at least one ignition aid, wherein the ratio by dry weight of carbon to ignition aid in the combustible first layer is greater than the ratio by dry weight of carbon to ignition aid in the second layer.

Suitable ignition aids for use in multilayer combustible heat sources according to the invention are known in the art.

Multilayer combustible heat sources according to certain embodiments of the invention may comprise one or more ignition aids consisting of a single element or compound that release energy upon ignition of the multilayer combustible heat source.

For example, in certain embodiments multilayer combustible heat sources according to the invention may comprise one or more energetic materials consisting of a single element or compound that reacts exothermically with oxygen upon ignition of the multilayer combustible heat sources. Examples of suitable energetic materials include, but are not limited to, aluminium, iron, magnesium and zirconium.

Alternatively or in addition, multilayer combustible heat sources according to the invention may comprise one or more ignition aids comprising two or more elements or compounds that react with one another to release energy upon ignition of the multilayer combustible heat source.

For example, in certain embodiments multilayer combustible heat sources according to the invention may comprise one or more thermites or thermite composites comprising a reducing agent such as, for example, a metal, and an oxidizing agent such as, for example, a metal oxide, that react with one another to release energy upon ignition of the multilayer combustible heat sources. Examples of suitable metals include, but are not limited to, magnesium, and examples of suitable metal oxides include, but are not limited to, iron oxide ($Fe_2O_3$) and aluminium oxide ($Al_2O_3$)

In other embodiments, multilayer combustible heat sources according to the invention may comprise one or more ignition aids comprising other materials that undergo exothermic reactions upon ignition of the multilayer combustible heat source. Examples of suitable metals include, but are not limited to, intermetallic and bi-metallic materials, metal carbides and metal hydrides.

Multilayer combustible heat sources according to the invention preferably comprise at least one ignition aid that releases oxygen during ignition of the multilayer combustible heat source.

In certain embodiments, the combustible first layer comprises carbon and the second layer comprises carbon and at least one ignition aid that releases oxygen during ignition of the multilayer combustible heat source.

In certain preferred embodiments, the combustible first layer comprises carbon and at least one ignition aid that releases oxygen during ignition of the multilayer combustible heat source and the second layer comprises carbon and at least one ignition aid that releases oxygen during ignition of the multilayer combustible heat source.

In such embodiments, the release of oxygen by the at least one ignition aid upon ignition of the multilayer combustible heat source indirectly results in a 'boost' in temperature during an initial first stage of combustion of the multilayer combustible heat source by increasing the rate of combustion of the multilayer combustible heat source. This is reflected in the temperature profile of the multilayer combustible heat source.

For example, multilayer combustible heat sources according to the invention may comprise one or more oxidizing agents that decompose to release oxygen upon ignition of the multilayer combustible heat source. Combustible heat sources according to the invention may comprise organic oxidizing agents, inorganic oxidizing agents or a combination thereof. Examples of suitable oxidizing agents include, but are not limited to: nitrates such as, for example, potassium nitrate, calcium nitrate, strontium nitrate, sodium nitrate, barium nitrate, lithium nitrate, aluminium nitrate and iron nitrate; nitrites; other organic and inorganic nitro compounds; chlorates such as, for example, sodium chlorate and potassium chlorate; perchlorates such as, for example, sodium perchlorate; chlorites; bromates such as, for example, sodium bromate and potassium bromate; perbromates; bromites; borates such as, for example, sodium borate and potassium borate; ferrates such as, for example, barium ferrate; ferrites; manganates such as, for example, potassium manganate; permanganates such as, for example, potassium permanganate; organic peroxides such as, for example, benzoyl peroxide and acetone peroxide; inorganic peroxides such as, for example, hydrogen peroxide, strontium peroxide, magnesium peroxide, calcium peroxide, barium peroxide, zinc peroxide and lithium peroxide; superoxides such as, for example, potassium superoxide and sodium superoxide; iodates; periodates; iodites; sulphates; sulfites; other sulfoxides; phosphates; phospinates; phosphites; and phosphanites.

Alternatively or in addition, multilayer combustible heat sources according to the invention may comprise one or more oxygen storage or sequestering materials that release oxygen upon ignition of the multilayer combustible heat source. Multilayer combustible heat sources according to the invention may comprise oxygen storage or sequestering materials that store and release oxygen by means of encapsulation, physisorption, chemisorption, structural change or a combination thereof. Examples of suitable oxygen storage or sequestering materials include, but are not limited to: metal surfaces such as, for example, metallic silver or metallic gold surfaces; mixed metal oxides; molecular sieves; zeolites; metal-organic frameworks; covalent organic frameworks; spinels; and perovskites.

Multilayer combustible heat sources according to the invention may comprise one or more ignition aids consisting of a single element or compound that release oxygen upon ignition of the multilayer combustible heat source. Alternatively or in addition, multilayer combustible heat sources according to the invention may comprise one or more ignition aids comprising two or more elements or compounds that react with one another to release oxygen upon ignition of the multilayer combustible heat source.

Multilayer combustible heat sources according to the invention may comprise one or more ignition aids that release both energy and oxygen upon ignition of the multilayer combustible heat source. For example, multilayer combustible heat sources according to the invention may comprise one or more oxidizing agents that decompose exothermically to release oxygen upon ignition of the multilayer combustible heat source.

Alternatively, or in addition, multilayer combustible heat sources according to the invention may comprise one or more first ignition aids that release energy upon ignition of the multilayer combustible heat source and one or more second ignition aids, which are different from the one or more first ignition aids, that release oxygen upon ignition of the multilayer combustible heat source.

In certain embodiments, multilayer combustible heat sources according to the invention may comprise at least one metal nitrate salt having a thermal decomposition temperature of less than about 600° C., more preferably of less than about 400° C. Preferably, the at least one metal nitrate salt has a decomposition temperature of between about 150° C. and about 600° C., more preferably of between about 200° C. and about 400° C.

In such embodiments, when the multilayer combustible heat source is exposed to a conventional yellow flame lighter or other ignition means, the at least one metal nitrate salt decomposes to release oxygen and energy. This causes an initial boost in the temperature of the multilayer combustible heat source and also aids in the ignition of the multilayer combustible heat source. Following total decomposition of the at least one metal nitrate salt, the multilayer combustible heat source continues to combust at a lower temperature.

The inclusion of at least one metal nitrate salt advantageously results in ignition of the multilayer combustible heat source being initiated internally, and not only at a point on the surface thereof.

In use the boost in temperature of the multilayer combustible heat source upon ignition thereof resulting from the decomposition of the at least one metal nitrate salt is reflected in an increase in temperature of the multilayer combustible heat source to a 'boost' temperature. In use in a smoking article according to the invention, this advantageously ensures that sufficient heat is available to be transferred from the multilayer combustible heat source to the aerosol-forming substrate of the smoking article and so facilitates production of an acceptable aerosol during early puffs thereof.

The subsequent decrease in temperature of the multilayer combustible heat source following the decomposition of the at least one metal nitrate salt is also reflected in a subsequent decrease in temperature of the multilayer combustible heat source to a 'cruising' temperature. In use in a smoking article according to the invention, this advantageously prevents or reduces thermal degradation or combustion the aerosol-forming substrate of the smoking article.

The magnitude and duration of the boost in temperature resulting from the decomposition of the at least one metal nitrate salt may be advantageously controlled through the nature, amount and location of the at least one metal nitrate salt in the multilayer combustible heat source. In particular, by providing different amounts of at least one metal nitrate salt in the combustible first layer and the second layer of multilayer combustible heat sources according to the invention, the magnitude and duration of the boost in temperature resulting from the decomposition of the at least one metal nitrate salt may be advantageously controlled so as to produce an acceptable aerosol during early puffs of smoking articles according to the invention while still providing an acceptable aerosol during late puffs thereof.

Preferably, the at least one metal nitrate salt is selected from the group consisting of potassium nitrate, sodium nitrate, calcium nitrate, strontium nitrate, barium nitrate, lithium nitrate, aluminium nitrate and iron nitrate.

Preferably, multilayer combustible heat sources according to the invention comprise at least two different metal nitrate salts. In one embodiment, multilayer combustible heat sources according to the invention comprise potassium nitrate, calcium nitrate and strontium nitrate.

In certain preferred embodiments, multilayer combustible heat sources according to the invention comprise at least one peroxide or superoxide that actively evolves oxygen at a temperature of less than about 600° C., more preferably at a temperature of less than about 400° C.

Preferably, the at least one peroxide or superoxide actively evolves oxygen at a temperature of between about 150° C. and about 600° C., more preferably of between about 200° C. and about 400° C., most preferably at a temperature of about 350° C.

In such embodiments, when the multilayer combustible heat source is exposed to a conventional yellow flame lighter or other ignition means, at least one peroxide or superoxide decomposes to release oxygen. This causes an initial boost in the temperature of the multilayer combustible heat source and also aids in the ignition of the multilayer combustible heat source. Following total decomposition of the at least one peroxide or superoxide, the multilayer combustible heat source continues to combust at a lower temperature.

The inclusion of at least one peroxide or superoxide advantageously results in ignition of the multilayer combustible heat source being initiated internally, and not only at a point on the surface thereof.

In use the boost in temperature of the multilayer combustible heat source upon ignition thereof resulting from the decomposition of the at least one peroxide or superoxide is reflected in an increase in temperature of the multilayer combustible heat source to a 'boost' temperature. In use in a smoking article according to the invention, this advantageously ensures that sufficient heat is available to be transferred from the combustible heat source to the aerosol-forming substrate of the smoking article and so facilitates production of an acceptable aerosol during early puffs thereof.

The subsequent decrease in temperature of the multilayer combustible heat source following the decomposition of the at least one peroxide or superoxide is also reflected in a subsequent decrease in temperature of the multilayer combustible heat source to a 'cruising' temperature. In use in a smoking article according to the invention, this advantageously prevents or reduces thermal degradation or combustion of the aerosol-forming substrate of the smoking article.

The magnitude and duration of the boost in temperature resulting from the decomposition of the at least one peroxide or superoxide may be advantageously controlled through the nature, amount and location of the at least one peroxide or superoxide in the multilayer combustible heat source. In particular, by providing different amounts of at least one peroxide or superoxide in the combustible first layer and the second layer of multilayer combustible heat sources according to the invention, the magnitude and duration of the boost in temperature resulting from the decomposition of the at least one peroxide or superoxide may be advantageously controlled so as to produce an acceptable aerosol during early puffs of smoking articles according to the invention while still providing an acceptable aerosol during late puffs thereof.

Suitable peroxides and superoxides for inclusion in multilayer combustible heat sources according to the invention include, but are not limited to, strontium peroxide, magnesium peroxide, barium peroxide, lithium peroxide, zinc peroxide, potassium superoxide and sodium superoxide.

Preferably, the at least one peroxide is selected from the group consisting of calcium peroxide, strontium peroxide, magnesium peroxide, barium peroxide and combinations thereof.

In certain embodiments, the combustible first layer comprises carbon and the second layer comprises carbon and at least one peroxide.

In certain preferred embodiments, the combustible first layer comprises carbon and at least one peroxide and the second layer comprises carbon and at least one peroxide, wherein the ratio by dry weight of carbon to peroxide in the combustible first layer is different from the ratio by dry weight of carbon to peroxide in the second layer.

In one preferred embodiment, the combustible first layer comprises carbon and at least one peroxide and the second layer comprises carbon and at least one peroxide, wherein the ratio by dry weight of carbon to peroxide in the combustible first layer is greater than the ratio by dry weight of carbon to peroxide in the second layer.

In certain particularly preferred embodiments, the combustible first layer comprises carbon and calcium peroxide and the second layer comprises carbon and calcium peroxide, wherein the ratio by dry weight of carbon to calcium peroxide in the combustible first layer is different from the ratio by dry weight of carbon to calcium peroxide in the second layer.

In one particularly preferred embodiment, the combustible first layer comprises carbon and calcium peroxide and the second layer comprises carbon and calcium peroxide, wherein the ratio by dry weight of carbon to calcium peroxide in the combustible first layer is greater than the ratio by dry weight of carbon to calcium peroxide in the second layer.

Layers of multilayer combustible heat sources according to the invention may further comprise one or more binders.

The one or more binders may be organic binders, inorganic binders or a combination thereof. Suitable known organic binders include but are not limited to: gums such as, for example, guar gum; modified celluloses and cellulose derivatives such as, for example, methyl cellulose, carboxymethyl cellulose, hydroxypropyl cellulose and hydroxypropyl methylcellulose; wheat flour; starches; sugars; vegetable oils; and combinations thereof.

Suitable known inorganic binders include, but are not limited to: clays such as, for example, bentonite and kaolinite; alumino-silicate derivatives such, for example, as cement, alkali activated alumino-silicates; alkali silicates such as, for example, sodium silicates and potassium silicates; limestone derivatives such as, for example, lime and hydrated lime; alkaline earth compounds and derivatives such as, for example, magnesia cement, magnesium sulfate, calcium sulfate, calcium phosphate and dicalcium phosphate; and aluminium compounds and derivatives such as, for example, aluminium sulphate.

In certain embodiments, layers of multilayer combustible heat sources according to the invention may be formed from a mixture comprising: carbon powder; modified cellulose, such as, for example, carboxymethyl cellulose; flour such as, for example, wheat flour; and sugar such as, for example, white crystalline sugar derived from beet.

In other embodiments, layers of multilayer combustible heat sources according to the invention may be formed from a mixture comprising: carbon powder; modified cellulose, such as, for example, carboxymethyl cellulose; and optionally bentonite.

Instead of, or in addition to one or more binders, layers of multilayer combustible heat sources according to the invention may comprise one or more additives in order to improve the properties of the multilayer combustible heat source. Suitable additives include, but are not limited to, additives to promote consolidation of the multilayer combustible heat source (for example, sintering aids), additives to promote combustion of the multilayer combustible heat source (for example, potassium and potassium salts, such as potassium citrate) and additives to promote decomposition of one or more gases produced by combustion of the multilayer combustible heat source (for example catalysts, such as CuO, $Fe_2O_3$ and $Al_2O_3$).

Preferably, the first layer and the second layer of multilayer combustible heat sources according to the invention are non-fibrous.

The first layer and the second layer of multilayer combustible heat sources according to the invention may be formed from one or more suitable carbon-containing materials. Suitable carbon-containing materials are well known in the art and include, but are not limited to, carbon powder.

Multilayer combustible heat sources according to the invention may have a total carbon content of at least about 35 percent. For example, multilayer combustible heat sources according to the invention may have a total carbon content of at least about 40 percent or of at least about 45 percent by dry weight.

In certain embodiments, multilayer combustible heat sources according to the invention may be carbon-based multilayer combustible heat sources. As used herein, the term 'carbon-based' is used to describe a multilayer combustible heat source comprised primarily of carbon.

Carbon-based multilayer combustible heat sources according to the invention may have a carbon content of at least about 50 percent, preferably of at least about 60 percent, more preferably of at least about 70 percent, most preferably of at least about 80 percent by dry weight.

The first layer and the second layer of multilayer combustible heat sources according to the invention have an apparent density of at least 0.6 g/cm$^3$.

The apparent density of the first layer and the second layer of multilayer combustible heat sources according to the invention may be calculated by dividing the mass of each layer by the volume of each layer.

For example, where the first layer and the second layer of bilayer combustible heat sources according to the invention are formed by pressing, the apparent density of the first layer and the second layer may be calculated by dividing the mass of material pressed to form each layer by the volume of each formed layer.

Alternatively, where the first layer and the second layer of bilayer combustible heat sources according to the invention are formed by extrusion, the apparent density of the first layer and the second layer may be calculated by removing one of the layers and calculating the density of the removed layer by dividing the mass of material removed by the volume of the layer prior to removal and calculating the density of the remaining layer by dividing the mass of the remaining layer by the volume of the remaining layer.

Preferably, the first layer and the second layer of multilayer combustible heat sources according to the invention have an apparent density of between about 0.6 g/cm$^3$ and about 1 g/cm$^3$.

The apparent density of the first layer may be the same as or different from the apparent density of the second layer.

Where the apparent density of the first layer is different from the apparent density of the second layer, the difference in the apparent density of the first layer and the apparent density of the second layer is preferably less than or equal to 0.2 g/cm$^3$ Preferably, multilayer combustible heat sources according to the invention have an apparent density of between about 0.6 g/cm$^3$ and about 1 g/cm$^3$.

Preferably, multilayer combustible heat sources according to the invention are elongate. More preferably, multilayer combustible heat sources according to the invention are substantially rod-shaped.

In particularly preferred embodiments, multilayer combustible heat sources according to the invention are substantially cylindrical.

Preferably, multilayer combustible heat sources according to the invention are of substantially uniform diameter. However, multilayer combustible heat sources according to the invention may alternatively be tapered such that the diameter of a first end of the multilayer combustible heat source is greater than the diameter of an opposed second thereof.

Preferably, multilayer combustible heat sources according to the invention are of substantially circular or substantially oval or substantially elliptical transverse cross-section. Most preferably, multilayer combustible heat sources according to the invention are of substantially circular transverse cross-section. However, in alternative embodiments multilayer combustible heat sources according to the invention may have transverse cross-sections of different shape. For example, multilayer combustible heat sources according to the invention may be of substantially triangular, square, rhomboidal, trapezoidal or octagonal transverse cross-section.

Preferably, multilayer combustible heat sources according to the invention have a length of between about 5 mm and about 20 mm, more preferably of between about 7 mm and about 15 mm, most preferably of between about 7 mm and about 13 mm.

Preferably, multilayer combustible heat sources according to the invention have a diameter of between about 5 mm and about 10 mm, more preferably of between about 6 mm and about 9 mm, most preferably of between about 7 mm and about 8 mm.

As used herein, the term 'diameter' denotes the maximum transverse dimension of multilayer combustible heat sources according to the invention.

The combustible first layer and the second layer of multilayer combustible heat sources according to the invention are longitudinal concentric layers.

In certain preferred embodiments, multilayer combustible heat sources according to the invention are substantially cylindrical and the combustible first layer and the second are longitudinal concentric layers.

In certain embodiments, the combustible first layer is an outer layer and the second layer is an inner layer, which is circumscribed by the combustible first layer.

In certain embodiments, the combustible first layer is an annular outer layer and the second layer is a substantially cylindrical inner layer, which is circumscribed by the combustible first layer.

In certain other embodiments, the second layer is an outer layer and the combustible first layer is an inner layer, which is circumscribed by the second layer.

In certain other embodiments, the second layer is an annular outer layer and the combustible first layer is a substantially cylindrical inner layer, which is circumscribed by the second layer.

In embodiments where the combustible first layer is an outer layer and the second layer is an inner layer, which is circumscribed by the combustible first layer, the second layer may advantageously act as a 'fuse' upon ignition of the multilayer combustible heat source. In addition in such embodiments, one or both of the occurrence and visibility of flaming and sparkling associated with the use of certain ignition aids and other additives may be advantageously eliminated or reduced by including such additives in the second layer of the multilayer combustible heat source while eliminating or reducing the presence of such additives in the combustible first layer.

In embodiments where the combustible first layer is an annular outer layer and the second layer is a substantially cylindrical inner layer, which is circumscribed by the combustible first layer, the multilayer combustible heat source may, for example, have a diameter of between about 5 mm and about 10 mm and the second layer may, for example, have a diameter of between about 0.5 mm and about 9 mm.

In embodiments where the second layer is an annular outer layer and the combustible first layer is a substantially cylindrical inner layer, which is circumscribed by the second layer, the multilayer combustible heat source may, for example, have a diameter of between about 5 mm and about 10 mm and the combustible first layer may, for example, have a diameter of between about 0.5 mm and about 9 mm.

Multilayer combustible heat sources according to the invention may comprise one or more additional layers.

Multilayer combustible heat sources according to the invention may comprise one or more additional layers having substantially the same composition as the combustible first layer.

Alternatively or in addition, multilayer combustible heat sources according to the invention may comprise one or more additional layers having substantially the same composition as the second layer.

Alternatively or in addition, multilayer combustible heat sources according to the invention may comprise one or more additional layers having a different composition from both the combustible first layer and the second layer.

Multilayer combustible heat sources according to the invention may comprise one or more additional layers substantially parallel to the combustible first layer and the second layer. In such embodiments, the combustible first layer, the second layer and the one or more additional layers meet along substantially parallel interfaces.

Alternatively or in addition, multilayer combustible heat sources according to the invention may comprise one or more additional layers substantially perpendicular to the combustible first layer and the second layer. In such embodiments, the combustible first layer meets the second layer along a first interface and the one or more additional layers meet one another and the combustible first layer and the second layer along a second interface substantially perpendicular to the first interface.

Multilayer combustible heat sources according to the invention may further comprise one or more additional longitudinal layers or one or more additional transverse layers or a combination of one or more additional longitudinal layers and one or more additional transverse layers.

Multilayer combustible heat sources according to the invention may further comprise one or more additional concentric layers or one or more additional non-concentric layers or a combination of one or more additional concentric layers and one or more additional non-concentric layers.

In certain preferred embodiments, multilayer combustible heat sources according to the invention further comprise a third layer comprising one or both of carbon and at least one ignition aid.

The third layer may be combustible or non-combustible.

The composition of the third layer may be substantially the same as or different from the composition of the combustible first layer. Preferably, the composition of the third layer is different from the composition of the combustible first layer.

The composition of the third layer may be substantially the same as or different from the composition of the second layer.

In certain preferred embodiments, the third layer comprises carbon.

In embodiments where the third layer comprises carbon, the carbon content of the combustible first layer is preferably greater than the carbon content of the third layer.

In embodiments where the third layer comprises carbon, the carbon content of the second layer is preferably greater than or substantially equal to the carbon content of the third layer.

In alternative embodiments where the third layer comprises carbon, the carbon content of the second layer may be less than the carbon content of the third layer.

In embodiments where the third layer comprises carbon, the third layer preferably has a carbon content of less than or equal to about 55 percent, more preferably of less than or equal to about 45 percent, most preferably of less than or equal to about 35 percent by dry weight. In certain preferred embodiments, the third layer preferably has a carbon content of less than or equal to about 25 percent by dry weight.

In certain preferred embodiments, the third layer comprises at least one ignition aid.

Where the third layer comprises at least one ignition aid, the at least one ignition aid in the third layer may be the same as or different from the at least one ignition aid in the second layer.

Where the combustible first layer comprises carbon and at least one ignition aid and the third layer comprises at least one ignition aid, the at least one ignition aid in the third layer may be the same as or different from the at least one ignition aid in the combustible first layer.

In embodiments where the third layer comprises at least one ignition aid, the ignition aid content of the third layer is preferably greater than or substantially equal to the ignition aid content of the second layer.

In alternative embodiments where the third layer comprises at least one ignition aid, the ignition aid content of the third layer may be less than the ignition aid content of the second layer.

In embodiments where the combustible first layer comprises carbon and at least one ignition aid and the third layer comprises at least one ignition aid, the ignition aid content of the third layer is preferably greater than the ignition aid content of the combustible first layer.

In alternative embodiments where the combustible first layer comprises carbon and at least one ignition aid and the third layer comprises at least one ignition aid, the ignition aid content of the third layer may be less than the ignition aid content of the combustible first layer.

In embodiments where the third layer comprises at least one ignition aid, the third layer preferably has an ignition aid content of at least about 30 percent, more preferably of at least about 40 percent, most preferably of at least about 50 percent by dry weight.

In certain preferred embodiments, the combustible first layer comprises carbon and at least one ignition aid, the second layer comprises carbon and at least one ignition aid and the third layer comprises carbon and at least one ignition aid, wherein the ratio by dry weight of carbon to ignition aid in the combustible first layer is different from the ratio by dry weight of carbon to ignition aid in the second layer.

In one preferred embodiment, the combustible first layer comprises carbon and at least one ignition aid, the second layer comprises carbon and at least one ignition aid and the third layer comprises carbon and at least one ignition aid, wherein the ratio by dry weight of carbon to ignition aid in the combustible first layer is greater than the ratio by dry weight of carbon to ignition aid in the second layer.

In one preferred embodiment, the combustible first layer comprises carbon and at least one ignition aid, the second layer comprises carbon and at least one ignition aid and the third layer comprises carbon and at least one ignition aid, wherein the ratio by dry weight of carbon to ignition aid in the combustible first layer is greater than the ratio by dry weight of carbon to ignition aid in the second layer and the ratio by dry weight of carbon to ignition aid in the second layer is greater than or substantially equal to the ratio by dry weight of carbon to ignition aid in the third layer.

In certain particularly preferred embodiments, the combustible first layer comprises carbon and calcium peroxide, the second layer comprises carbon and calcium peroxide and the third layer comprises carbon and calcium peroxide, wherein the ratio by dry weight of carbon to calcium peroxide in the combustible first layer is different from the ratio by dry weight of carbon to calcium peroxide in the second layer.

In one particularly preferred embodiment, the combustible first layer comprises carbon and calcium peroxide, the second layer comprises carbon and calcium peroxide and the third layer comprises carbon and calcium peroxide, wherein the ratio by dry weight of carbon to calcium peroxide in the combustible first layer is greater than the ratio by dry weight of carbon to calcium peroxide in the second layer.

In one particularly preferred embodiment, the combustible first layer comprises carbon and calcium peroxide, the second layer comprises carbon and calcium peroxide and the third layer comprises carbon and calcium peroxide, wherein the ratio by dry weight of carbon to calcium peroxide in the combustible first layer is greater than the ratio by dry weight of carbon to calcium peroxide in the second layer and the ratio by dry weight of carbon to calcium peroxide in the second layer is greater than or substantially equal to the ratio by dry weight of carbon to calcium peroxide in the third layer.

In an alternative embodiment, the combustible first layer comprises carbon and calcium peroxide, the second layer comprises carbon and calcium peroxide and the third layer comprises carbon and calcium peroxide, wherein the ratio by dry weight of carbon to calcium peroxide in the combustible first layer is greater than the ratio by dry weight of carbon to calcium peroxide in the second layer and the ratio by dry weight of carbon to calcium peroxide in the second layer is less than the ratio by dry weight of carbon to calcium peroxide in the third layer.

The third layer may be substantially parallel to the combustible first layer and the second layer. In such embodiments, the combustible first layer, the second layer and third layer meet along substantially parallel interfaces.

Alternatively, the third layer may be substantially perpendicular to the combustible first layer and the second layer. In such embodiments, the combustible first layer meets the second layer along a first interface and the third layer meets the combustible first layer and the second layer along a second interface substantially perpendicular to the first interface.

The third layer may be a longitudinal layer or a transverse layer.

The third layer may be a concentric layer or a non-concentric layer.

In certain preferred embodiments, the third layer is a non-concentric layer.

In certain embodiments, the combustible first layer is a longitudinal outer layer, the second layer is a longitudinal inner layer, which is circumscribed by the combustible first layer, and the third layer is a transverse layer.

In certain embodiments, the combustible first layer is an annular longitudinal outer layer, the second layer is a substantially cylindrical longitudinal inner layer, which is circumscribed by the combustible first layer, and the third layer is a transverse layer.

In certain other embodiments, the second layer is a longitudinal outer layer, the combustible first layer is a longitudinal inner layer, which is circumscribed by the second layer, and the third layer is a transverse layer.

In certain other embodiments, the second layer is an annular longitudinal outer layer, the combustible first layer is a substantially cylindrical longitudinal inner layer, which is circumscribed by the second layer, and the third layer is a transverse layer.

In embodiments where the combustible first layer is an annular longitudinal outer layer, the second layer is a substantially cylindrical longitudinal inner layer circumscribed by the combustible first layer and the third layer is a transverse layer, the multilayer combustible heat source may, for example, have a diameter of between about 5 mm and about 10 mm, the second layer may, for example, have a diameter of between about 0.5 mm and about 9 mm and the third layer may, for example, have a length of between about 1 mm and about 10 mm.

In embodiments where the second layer is an annular longitudinal outer layer, the combustible first layer is a substantially cylindrical longitudinal inner layer circumscribed by the second layer and the third layer is a transverse layer, the multilayer combustible heat source may, for example, have a diameter of between about 5 mm and about 10 mm, the combustible first layer may, for example, have a diameter of between about 0.5 mm and about 9 mm and the third layer may, for example, have a length of between about 1 mm and about 10 mm.

To make multilayer combustible heat sources according to the invention, carbon and any other components of the combustible first layer, the at least one ignition aid and any other components of the second layer and, where present, the components of the third layer and any other additional layers of the multilayer combustible heat source are mixed and formed into a desired shape. The components of the combustible first layer, the components of the second layer and, where present, the components of the third layer and any other additional layers may be formed into a desired shape using any suitable known ceramic forming methods such as, for example, slip casting, extrusion, injection moulding and die compaction or pressing or a combination thereof. Preferably, the components of the combustible first layer, the components of the second layer and, where present, the components of the third layer and any other additional layers are formed into a desired shape by pressing or extrusion or a combination thereof.

In certain embodiments, multilayer combustible heat sources according to the invention may be made by forming the combustible first layer, the second layer and, where present, the third layer and any other additional layers using a single method.

For example, multilayer combustible heat sources according to the invention may be made by forming the combustible first layer, the second layer and, where present, the third layer and any other additional layers by extrusion.

Alternatively, multilayer combustible heat sources according to the invention may be made by forming the combustible first layer, the second layer and, where present, the third layer and any other additional layers by pressing.

In other embodiments, multilayer combustible heat sources according to the invention may be made by forming the combustible first layer, the second layer and, where present, the third layer and any other additional layers using two or more different methods.

For example, where multilayer combustible heat sources according to the invention comprise a first combustible layer, a second layer and a third layer and the combustible first layer and the second layer are longitudinal layers and the third layer is a transverse layer, multilayer combustible heat sources according to the invention may be made by forming the combustible first layer and the second layer by extrusion and forming the third layer by pressing.

Preferably, the components of the combustible first layer, the components of the second layer and, where present, the components of the third layer and any other additional layers are formed into a cylindrical rod. However, it will be appreciated that the components of the combustible first layer, the components of the second layer and, where present, the components of the third layer and any other additional layers may be formed into other desired shapes.

After formation, the cylindrical rod or other desired shape may be dried to reduce its moisture content.

The formed multilayer combustible heat source is preferably not pyrolised where the one or more layers of the multilayer combustible heat source comprises at least one ignition aid selected from the group consisting of peroxides, thermites, intermetallics, magnesium, aluminium and zirconium.

In other embodiments the formed multilayer combustible heat source is pyrolysed in a non-oxidizing atmosphere at a temperature sufficient to carbonise any binders, where present, and substantially eliminate any volatiles in the formed multilayer combustible heat source. In such embodiments, the formed multilayer combustible heat source is preferably pyrolysed in a nitrogen atmosphere at a temperature of between about 700° C. and about 900° C. At least one metal nitrate salt may be incorporated in multilayer combustible heat sources according to the invention by including at least one metal nitrate precursor in the mixture of components formed into the dried cylindrical rod or other desired shape and then subsequently converting the at least one metal nitrate precursor into at least one metal nitrate salt in-situ, by treating the pyrolysed formed multilayer combustible heat source with an aqueous solution of nitric acid.

The at least one metal nitrate precursor may be any metal or metal-containing compound such as, for example, metal oxide or metal carbonate, that reacts with nitric acid to form a metal nitrate salt. Suitable metal nitrate salt precursors include, but are not limited to calcium carbonate, potassium carbonate, calcium oxide, strontium carbonate, lithium carbonate and dolomite (calcium magnesium carbonate).

Preferably, the concentration of the aqueous solution of nitric acid is between about 20% and about 50% by dry weight, more preferably of between about 30% and about 40% by dry weight. As well as converting the at least one metal nitrate precursor to at least one metal nitrate salt, treatment of carbonaceous multilayer combustible heat sources according to the invention with nitric acid advantageously enhances the porosity of the carbonaceous multilayer combustible heat sources and activates the carbon structure by increasing the surface area thereof.

Smoking articles according to the invention may comprise a non-combustible, substantially air impermeable, barrier between a downstream end of the multilayer combustible heat source and an upstream end of the aerosol-forming substrate.

As used herein, the term 'non-combustible' is used to describe a barrier that is substantially non-combustible at temperatures reached by the multilayer combustible heat source during combustion or ignition thereof.

The barrier may abut one or both of the downstream end of the multilayer combustible heat source and the upstream end of the aerosol-forming substrate.

The barrier may be adhered or otherwise affixed to one or both of the downstream end of the multilayer combustible heat source and the upstream end of the aerosol-forming substrate.

In some embodiments, the barrier comprises a barrier coating provided on a rear face of the multilayer combustible heat source. In such embodiments, preferably the barrier comprises a barrier coating provided on at least substantially the entire rear face of the multilayer combustible heat source. More preferably, the barrier comprises a barrier coating provided on the entire rear face of the multilayer combustible heat source.

As used herein, the term 'coating' is used to describe a layer of material that covers and is adhered to the multilayer combustible heat source.

The barrier may advantageously limit the temperature to which the aerosol-forming substrate is exposed during ignition or combustion of the multilayer combustible heat source, and so help to avoid or reduce thermal degradation or combustion of the aerosol-forming substrate during use of the smoking article.

Depending upon the desired characteristics and performance of the smoking article, the barrier may have a low thermal conductivity or a high thermal conductivity. In certain embodiments, the barrier may be formed from material having a bulk thermal conductivity of between about 0.1 W per metre Kelvin (W/(m·K)) and about 200 W per metre Kelvin (W/(m·K)), at 23° C. and a relative humidity of 50% as measured using the modified transient plane source (MTPS) method.

The thickness of the barrier may be appropriately adjusted to achieve good smoking performance. In certain embodiments, the barrier may have a thickness of between about 10 microns and about 500 microns.

The barrier may be formed from one or more suitable materials that are substantially thermally stable and non-combustible at temperatures achieved by the multilayer combustible heat source during ignition and combustion. Suitable materials are known in the art and include, but are not limited to, clays (such as, for example, bentonite and kaolinite), glasses, minerals, ceramic materials, resins, metals and combinations thereof.

Preferred materials from which the barrier may be formed include clays and glasses. More preferred materials from which the barrier may be formed include copper, aluminium, stainless steel, alloys, alumina ($Al_2O_3$), resins, and mineral glues.

In one embodiment, the barrier comprises a clay coating comprising a 50/50 mixture of bentonite and kaolinite provided on the rear face of the multilayer combustible heat source. In one more preferred embodiment, the barrier comprises an aluminium coating provided on a rear face of the multilayer combustible heat source. In another preferred embodiment, the barrier comprises a glass coating, more preferably a sintered glass coating, provided on a rear face of the multilayer combustible heat source.

Preferably, the barrier has a thickness of at least about 10 microns. Due to the slight permeability of clays to air, in embodiments where the barrier comprises a clay coating provided on the rear face of the multilayer combustible heat source, the clay coating more preferably has a thickness of at least about 50 microns, and most preferably of between about 50 microns and about 350 microns. In embodiments where the barrier is formed from one or more materials that are more impervious to air, such as aluminium, the barrier may be thinner, and generally will preferably have a thickness of less than about 100 microns, and more preferably of about 20 microns. In embodiments where the barrier comprises a glass coating provided on the rear face of the combustible heat source, the glass coating preferably has a thickness of less than about 200 microns. The thickness of the barrier may be measured using a microscope, a scanning electron microscope (SEM) or any other suitable measurement methods known in the art.

Where the barrier comprises a barrier coating provided on a rear face of the multilayer combustible heat source, the barrier coating may be applied to cover and adhere to the rear face of the multilayer combustible heat source by any suitable methods known in the art including, but not limited to, spray-coating, vapour deposition, dipping, material transfer (for example, brushing or gluing), electrostatic deposition or any combination thereof.

For example, the barrier coating may be made by preforming a barrier in the approximate size and shape of the rear face of the multilayer combustible heat source, and applying it to the rear face of the multilayer combustible heat source to cover and adhere to at least substantially the entire rear face of the multilayer combustible heat source. Alternatively, the barrier coating may be cut or otherwise machined after it is applied to the rear face of the multilayer combustible heat source. In one preferred embodiment, aluminium foil is applied to the rear face of the multilayer combustible heat source by gluing or pressing it to the multilayer combustible heat source, and is cut or otherwise machined so that the aluminium foil covers and adheres to at least substantially the entire rear face of the multilayer combustible heat source, preferably to the entire rear face of the multilayer combustible heat source.

In another preferred embodiment, the barrier coating is formed by applying a solution or suspension of one or more suitable coating materials to the rear face of the multilayer combustible heat source. For example, the barrier coating may be applied to the rear face of the multilayer combustible heat source by dipping the rear face of the multilayer combustible heat source in a solution or suspension of one or more suitable coating materials or by brushing or spray-coating a solution or suspension or electrostatically depositing a powder or powder mixture of one or more suitable coating materials onto the rear face of the multilayer combustible heat source. Where the barrier coating is applied to the rear face of the multilayer combustible heat source by electrostatically depositing a powder or powder mixture of one or more suitable coating materials onto the rear face of the multilayer combustible heat source, the rear face of the multilayer combustible heat source is preferably pre-treated with water glass before electrostatic deposition. Preferably, the barrier coating is applied by spray-coating.

The barrier coating may be formed through a single application of a solution or suspension of one or more suitable coating materials to the rear face of the multilayer combustible heat source. Alternatively, the barrier coating may be formed through multiple applications of a solution or suspension of one or more suitable coating materials to the rear face of the multilayer combustible heat source. For example, the barrier coating may be formed through one, two, three, four, five, six, seven or eight successive applications of a solution or suspension of one or more suitable coating materials to the rear face of the multilayer combustible heat source.

Preferably, the barrier coating is formed through between one and ten applications of a solution or suspension of one or more suitable coating materials to the rear face of the multilayer combustible heat source.

After application of the solution or suspension of one or more coating materials to the rear face thereof, the multilayer combustible heat source may be dried to form the barrier coating.

Where the barrier coating is formed through multiple applications of a solution or suspension of one or more suitable coating materials to the rear face thereof, the multilayer combustible heat source may need to be dried between successive applications of the solution or suspension.

Alternatively or in addition to drying, after application of a solution or suspension of one or more coating materials to the rear face of the multilayer combustible heat source, the coating material on the multilayer combustible heat source may be sintered in order to form the barrier coating. Sintering of the barrier coating is particularly preferred where the barrier coating is a glass or ceramic coating. Preferably, the barrier coating is sintered at a temperature of between about 500° C. and about 900° C., and more preferably at about 700° C.

In certain embodiments, smoking articles according to the invention may comprise multilayer combustible heat sources that do not comprise any airflow channels. The multilayer combustible heat sources of smoking articles according to such embodiments are referred to herein as blind multilayer combustible heat sources.

In smoking articles according to the invention comprising blind multilayer combustible heat sources, heat transfer from the multilayer combustible heat source to the aerosol-forming substrate occurs primarily by conduction and heating of the aerosol-forming substrate by convection is minimised or reduced. This advantageously helps to minimise or reduce the impact of a user's puffing regime on the composition of the mainstream aerosol of smoking articles according to the invention comprising blind multilayer combustible heat sources.

It will be appreciated that smoking articles according to the invention may comprise blind multilayer combustible heat sources comprising one or more closed or blocked passageways through which air may not be drawn for inhalation by a user. For example, smoking articles according to the invention may comprise blind multilayer combustible heat sources comprising one or more closed passageways that extend from an upstream end face of the multilayer combustible heat source only part way along the length of the multilayer combustible heat source.

In such embodiments, the inclusion of one or more closed air passageways increases the surface area of the multilayer combustible heat source that is exposed to oxygen from the air and may advantageously facilitate ignition and sustained combustion of the multilayer combustible heat source.

In other embodiments, smoking articles according to the invention may comprise multilayer combustible heat sources comprising one or more airflow channels. The multilayer combustible heat sources of smoking articles according to such embodiments are referred to herein as non-blind multilayer combustible heat sources.

In smoking articles according to the invention comprising non-blind multilayer combustible heat sources, heating of the aerosol-forming substrate occurs by conduction and convection. In use, when a user puffs on a smoking article according to the invention comprising a non-blind multilayer combustible heat source air is drawn downstream through the one or more airflow channels along the multilayer combustible heat source. The drawn air passes through the aerosol-forming substrate and then downstream towards the mouth end of the smoking article.

Smoking articles according to the invention may comprise non-blind multilayer combustible heat sources comprising one or more enclosed airflow channels along the multilayer combustible heat source.

As used herein, the term 'enclosed' is used to describe airflow channels that are surrounded by the multilayer combustible heat source along their length.

For example, smoking articles according to the invention may comprise non-blind multilayer combustible heat sources comprising one or more enclosed airflow channels that extend through the interior of the multilayer combustible heat source along the entire length of the multilayer combustible heat source.

Alternatively or in addition, smoking articles according to the invention may comprise non-blind multilayer combustible heat sources comprising one or more non-enclosed airflow channels along the multilayer combustible heat source.

For example, smoking articles according to the invention may comprise non-blind multilayer combustible heat sources comprising one or more non-enclosed airflow channels that extend along the exterior of the multilayer combustible heat source along at least a downstream portion of the length of the multilayer combustible heat source.

In certain embodiments, smoking articles according to the invention may comprise non-blind multilayer combustible heat sources comprising one, two or three airflow channels. In certain preferred embodiments, smoking articles according to the invention comprise non-blind multilayer combustible heat sources comprising a single airflow channel extending through the interior of the multilayer combustible heat source. In certain particularly preferred embodiments, smoking articles according to the invention comprise non-blind multilayer combustible heat sources comprising a single substantially central or axial airflow channel extending through the interior of the multilayer combustible heat source. In such embodiments, the diameter of the single airflow channel is preferably between about 1.5 mm and about 3 mm.

Where smoking articles according to the invention comprise a barrier comprising a barrier coating provided on a rear face of a non-blind multilayer combustible heat source comprising one or more airflow channels along the multilayer combustible heat source, the barrier coating should allow air to be drawn downstream through the one or more airflow channels.

Where smoking articles according to the invention comprise non-blind multilayer combustible heat sources, the smoking articles may further comprise a non-combustible, substantially air impermeable, barrier between the multilayer combustible heat source and the one or more airflow channels to isolate the non-blind multilayer combustible heat source from air drawn through the smoking article.

In some embodiments, the barrier may be adhered or otherwise affixed to the multilayer combustible heat source.

Preferably, the barrier comprises a barrier coating provided on an inner surface of the one or more airflow channels. More preferably, the barrier comprises a barrier coating provided on at least substantially the entire inner surface of the one or more airflow channels. Most preferably, the barrier comprises a barrier coating provided on the entire inner surface of the one or more airflow channels.

Alternatively, the barrier coating may be provided by insertion of a liner into the one or more airflow channels. For example, where smoking articles according to the invention comprise non-blind multilayer combustible heat sources comprising one or more airflow channels that extend through the interior of the multilayer combustible heat source, a non-combustible, substantially air impermeable hollow tube may be inserted into each of the one or more airflow channels.

The barrier may advantageously substantially prevent or inhibit combustion and decomposition products formed during ignition and combustion of the multilayer combustible heat source of smoking articles according to the invention from entering air drawn downstream along the one or more airflow channels.

The barrier may also advantageously substantially prevent or inhibit activation of combustion of the multilayer combustible heat source of smoking articles according to the invention during puffing by a user.

Depending upon the desired characteristics and performance of the smoking article, the barrier may have a low thermal conductivity or a high thermal conductivity. Preferably, the barrier has a low thermal conductivity.

The thickness of the barrier may be appropriately adjusted to achieve good smoking performance. In certain embodiments, the barrier may have a thickness of between about 30 microns and about 200 microns. In a preferred embodiment, the barrier has a thickness of between about 30 microns and about 100 microns.

The barrier may be formed from one or more suitable materials that are substantially thermally stable and non-combustible at temperatures achieved by the multilayer combustible heat source during ignition and combustion. Suitable materials are known in the art and include, but are not limited to, for example: clays; metal oxides, such as iron oxide, alumina, titania, silica, silica-alumina, zirconia and ceria; zeolites; zirconium phosphate; and other ceramic materials or combinations thereof.

Preferred materials from which the barrier may be formed include clays, glasses, aluminium, iron oxide and combinations thereof. If desired, catalytic ingredients, such as ingredients that promote the oxidation of carbon monoxide to carbon dioxide, may be incorporated in the barrier. Suitable catalytic ingredients include, but are not limited to, for example, platinum, palladium, transition metals and their oxides.

Where smoking articles according to the invention comprise a barrier between a downstream end of the multilayer combustible heat source and an upstream end of the aerosol-forming substrate and a barrier between the multilayer combustible heat source and one or more airflow channels along the multilayer combustible heat source, the two barriers may be formed from the same or different material or materials.

Where the barrier between the multilayer combustible heat source and the one or more airflow channels comprises a barrier coating provided on an inner surface of the one or more airflow channels, the barrier coating may be applied to the inner surface of the one or more airflow channels by any suitable method, such as the methods described in U.S. Pat. No. 5,040,551. For example, the inner surface of the one or more airflow channels may be sprayed, wetted or painted with a solution or a suspension of the barrier coating. In a preferred embodiment, the barrier coating is applied to the inner surface of the one or more airflow channels by the process described in WO-A2-2009/074870 as the multilayer combustible heat source is extruded.

The multilayer combustible heat source and aerosol-forming substrate of smoking articles according to the invention may substantially abut one another. Alternatively, the multilayer combustible heat source and aerosol-forming substrate of smoking articles according to the invention may be longitudinally spaced apart from one another.

Preferably, smoking articles according to the invention further comprise a heat-conducting element around and in direct contact with a rear portion of the multilayer combustible heat source and an adjacent front portion of the aerosol-forming substrate. The heat-conducting element is preferably combustion resistant and oxygen restricting.

In such embodiments, one or both of the occurrence and visibility of flaming and sparkling associated with the use of certain ignition aids and other additives may be advantageously eliminated or reduced by including such additives in the rear portion of the multilayer combustible heat source surrounded by the heat-conducting element.

For example, where the combustible first layer is an annular longitudinal outer layer, the second layer is a substantially cylindrical longitudinal inner layer, which is circumscribed by the combustible first layer, and the third layer is a transverse layer, the third layer may be located at the rear of the multilayer combustible heat source and such additives may be included in the third layer.

The heat-conducting element is around and in direct contact with the peripheries of both the rear portion of the multilayer combustible heat source and the front portion of the aerosol-forming substrate. The heat-conducting element provides a thermal link between these two components of smoking articles according to the invention.

Suitable heat-conducting elements for use in smoking articles according to the invention include, but are not limited to: metal foil wrappers such as, for example, aluminium foil wrappers, steel wrappers, iron foil wrappers and copper foil wrappers; and metal alloy foil wrappers.

Preferably, the rear portion of the multilayer combustible heat source surrounded by the heat-conducting element is between about 2 mm and about 8 mm in length, more preferably between about 3 mm and about 5 mm in length.

Preferably, the front portion of the multilayer combustible heat source not surrounded by the heat-conducting element is between about 4 mm and about 15 mm in length, more preferably between about 4 mm and about 8 mm in length.

Preferably, the aerosol-forming substrate has a length of between about 5 mm and about 20 mm, more preferably of between about 8 mm and about 12 mm.

In certain preferred embodiments, the aerosol-forming substrate extends at least about 3 mm downstream beyond the heat-conducting element.

Preferably, the front portion of the aerosol-forming substrate surrounded by the heat-conducting element is between about 2 mm and about 10 mm in length, more preferably between about 3 mm and about 8 mm in length, most preferably between about 4 mm and about 6 mm in length. Preferably, the rear portion of the aerosol-forming substrate not surrounded by the heat-conducting element is between about 3 mm and about 10 mm in length. In other words, the aerosol-forming substrate preferably extends between about 3 mm and about 10 mm downstream beyond the heat-conducting element. More preferably, the aerosol-forming substrate extends at least about 4 mm downstream beyond the heat-conducting element.

In other embodiments, the aerosol-forming substrate may extend less than 3 mm downstream beyond the heat-conducting element.

In yet further embodiments, the entire length of the aerosol-forming substrate may be surrounded by the heat-conducting element.

Preferably, smoking articles according to the invention comprise aerosol-forming substrates comprising a material capable of emitting volatile compounds in response to heating and at least one aerosol-former.

Preferably, the material capable of emitting volatile compounds in response to heating is a charge of plant-based material, more preferably a charge of homogenised plant-based material. For example, the aerosol-forming substrate may comprise one or more materials derived from plants including, but not limited to: tobacco; tea, for example green tea; peppermint; laurel; eucalyptus; basil; sage; verbena; and tarragon. The plant based-material may comprise additives including, but not limited to, humectants, flavourants, binders and mixtures thereof. Preferably, the plant-based material consists essentially of tobacco material, most preferably homogenised tobacco material.

The at least one aerosol-former may be any suitable known compound or mixture of compounds that, in use, facilitates formation of a dense and stable aerosol and that is substantially resistant to thermal degradation at the operating temperature of the smoking article. Suitable aerosol-formers are well known in the art and include, for example, polyhydric alcohols, esters of polyhydric alcohols, such as glycerol mono-, di- or triacetate, and aliphatic esters of mono-, di- or polycarboxylic acids, such as dimethyl dodecanedioate and dimethyl tetradecanedioate. Preferred aerosol formers for use in smoking articles according to the invention are polyhydric alcohols or mixtures thereof, such as triethylene glycol, 1,3-butanediol and, most preferred, glycerine.

Smoking articles according to the invention preferably further comprise an expansion chamber downstream of the aerosol-forming substrate. The inclusion of an expansion chamber advantageously allows further cooling of the aerosol generated by heat transfer from the multilayer combustible heat source to the aerosol-forming substrate. The expansion chamber also advantageously allows the overall length of smoking articles according to the invention to be adjusted to a desired value, for example to a length similar to that of conventional cigarettes, through an appropriate choice of the length of the expansion chamber. Preferably, the expansion chamber is an elongate hollow tube.

Smoking articles according to the invention may also further comprise a mouthpiece downstream of the aerosol-forming substrate and, where present, downstream of the expansion chamber. Preferably, the mouthpiece is of low filtration efficiency, more preferably of very low filtration efficiency. The mouthpiece may be a single segment or component mouthpiece. Alternatively, the mouthpiece may be a multi-segment or multi-component mouthpiece.

The mouthpiece may, for example, comprise a filter made of cellulose acetate, paper or other suitable known filtration materials. Alternatively or in addition, the mouthpiece may comprise one or more segments comprising absorbents, adsorbents, flavourants, and other aerosol modifiers and additives or combinations thereof.

Preferably, smoking articles according to the invention comprise an outer wrapper that circumscribes at least a rear portion of the multilayer combustible heat source, the aerosol-forming substrate and any other components of the smoking article downstream of the aerosol-forming substrate. Preferably, the outer wrapper is substantially air impermeable. Smoking articles according to the invention may comprise outer wrappers formed from any suitable material or combination of materials. Suitable materials are well known in the art and include, but are not limited to, cigarette paper. The outer wrapper should grip the heat source and aerosol-forming substrate of the smoking article when the smoking article is assembled.

Features described in relation to one aspect of the invention may also be applicable to other aspects of the invention. In particular, features described in relation to multilayer combustible heat sources according to the invention may also be applicable to smoking articles according to the invention and vice versa.

The invention will be further described, by way of example only, with reference to the accompanying drawings in which.

Figure 3A:
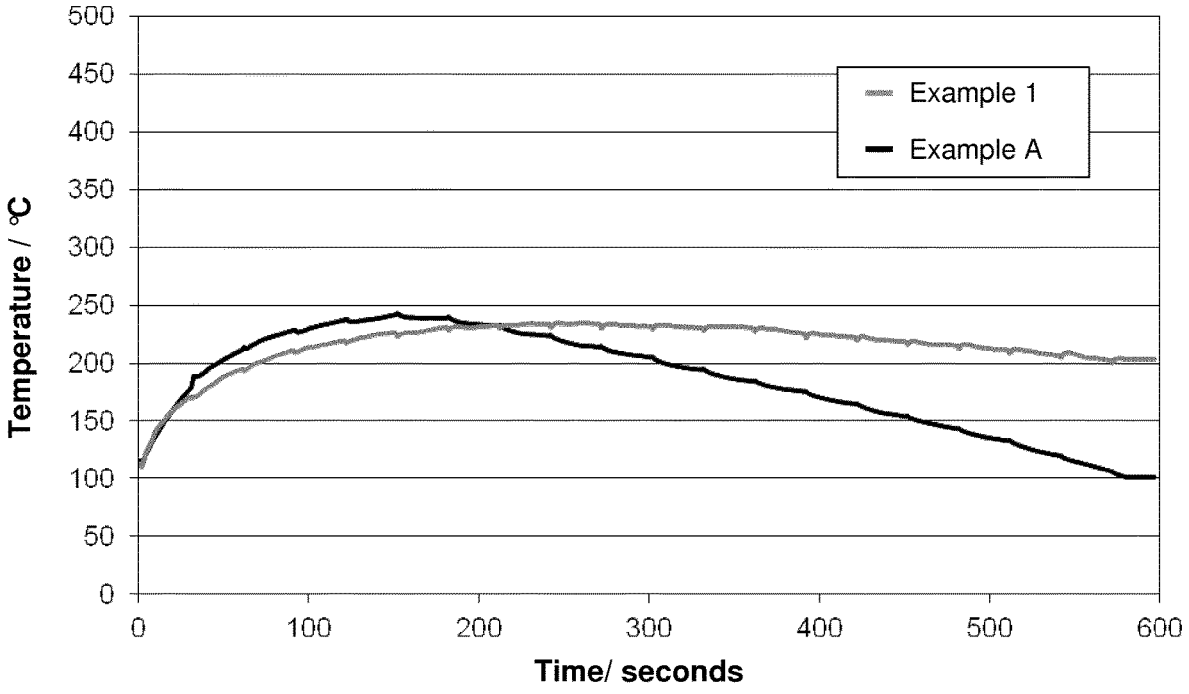
Figure 3B:
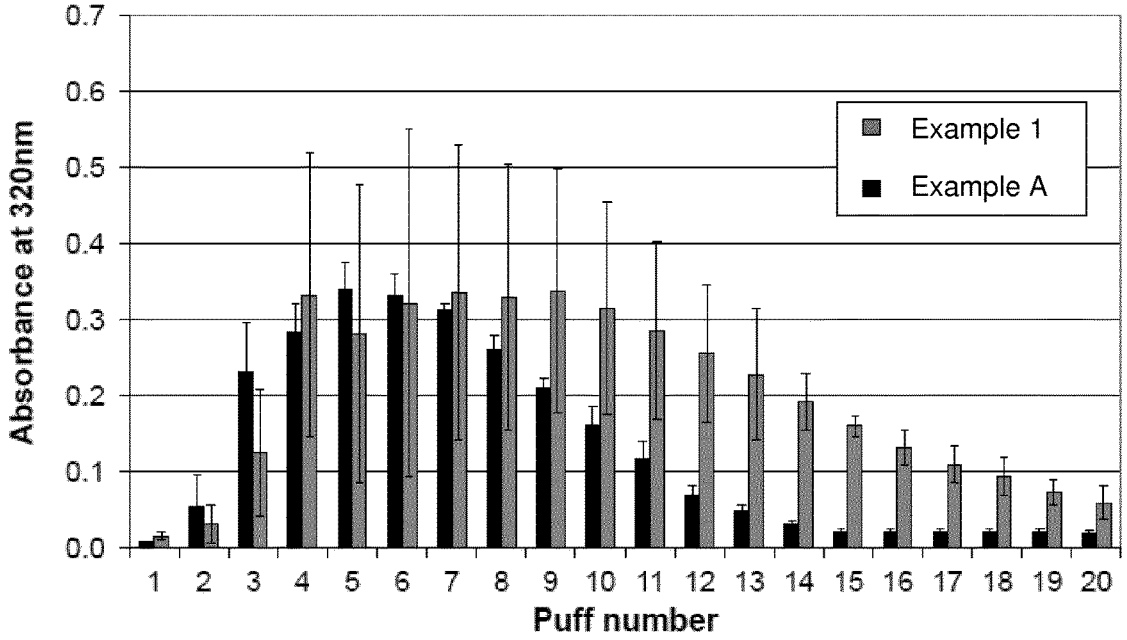
Figure 4A:
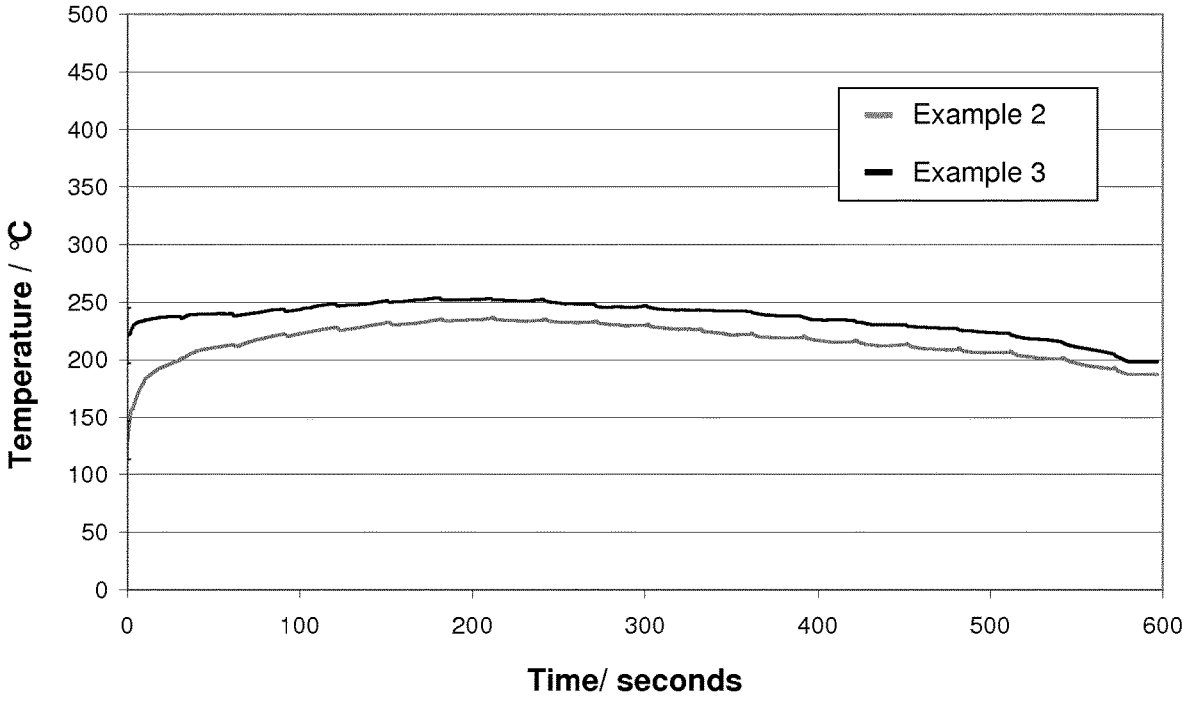
Figure 4B:
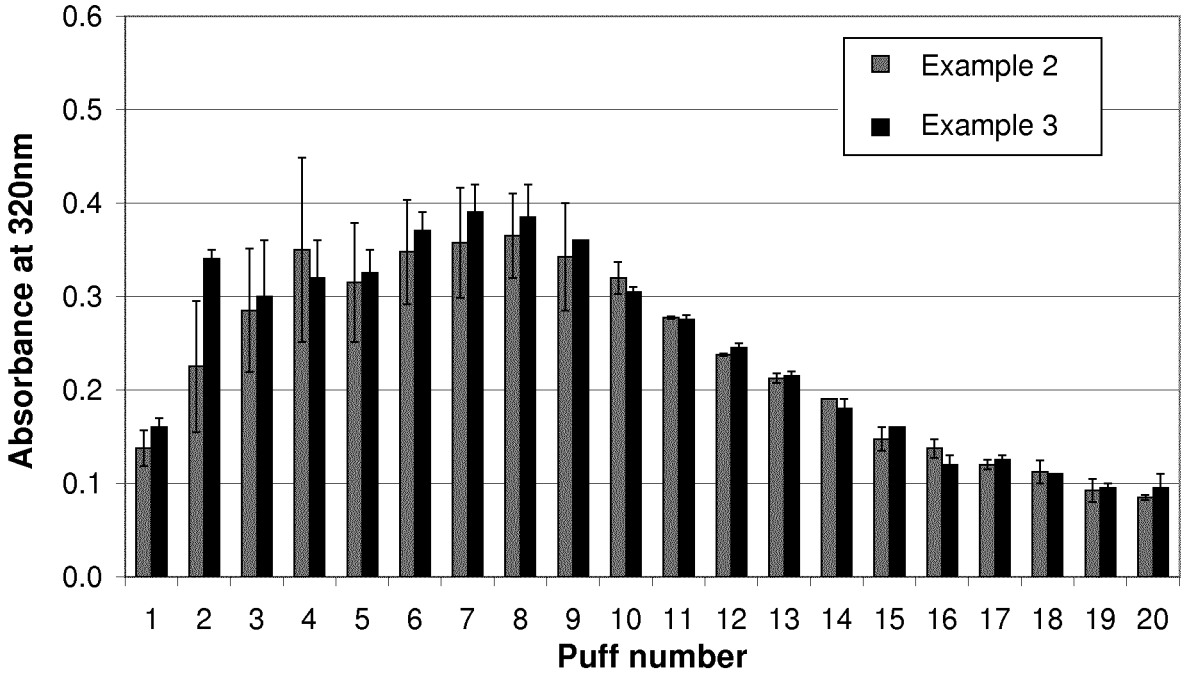

FIG. 3*a* shows a graph of the temperature of the aerosol-forming substrate of a smoking article according to the invention described in Example 1 during combustion of the multilayer combustible heat source thereof;

FIG. 3*b* shows a graph of the absorbance at 320 nm of the aerosol generated by the smoking article according to the invention described in Example 1 as a function of puff number;

FIG. 4*a* shows a graph of the temperature of the aerosol-forming substrate of a smoking article according to the invention described in Example 2 during combustion of the multilayer combustible heat source thereof; and FIG. 4*b* shows a graph of the absorbance at 320 nm of the aerosol generated by the smoking article according to the invention described in Example 2 as a function of puff number.

Figure 1:
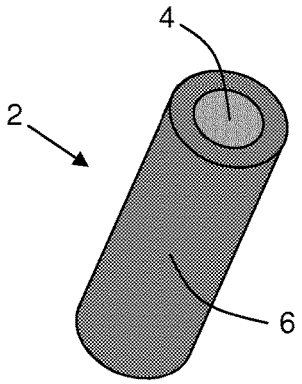
FIG. 1 is a perspective view of a multilayer combustible heat source according to a first embodiment of the invention.

The multilayer combustible heat source 2 according to the first embodiment of the invention shown in FIG. 1 is a substantially cylindrical, bilayer combustible heat source comprising a combustible first layer 4 and a second layer 6. As shown in FIG. 1, the second layer 6 is an annular longitudinal outer layer and the combustible first layer 4 is a substantially cylindrical longitudinal inner layer, which is circumscribed by the second layer 6. The inner diameter of the annular longitudinal outer second layer 6 is substantially equal to the diameter of the substantially cylindrical longitudinal inner combustible first layer 4.

Figure 2:
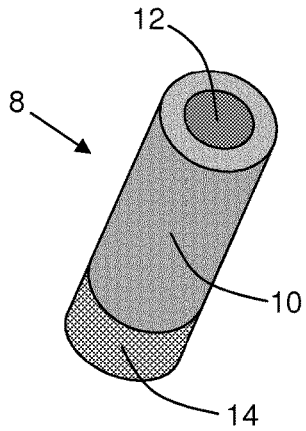
FIG. 2 is a perspective view of a multilayer combustible heat source according to a second embodiment of the invention.

The multilayer combustible heat source 8 according to the second embodiment of the invention shown in FIG. 2 is a substantially cylindrical, trilayer combustible heat source comprising a combustible first layer 10, a second layer 12 and a third layer 14. As shown in FIG. 2, the combustible first layer 10 is an annular longitudinal outer layer, the second layer 12 is a substantially cylindrical longitudinal inner layer, which is circumscribed by the combustible first layer 10, and the third layer 14 is a substantially cylindrical transverse layer. The inner diameter of the annular longitudinal outer combustible first layer 10 is substantially equal to the diameter of the substantially cylindrical longitudinal inner second layer 12. The outer diameter of the annular longitudinal outer combustible first layer 10 is substantially equal to the diameter of the substantially cylindrical transverse third layer 14.

EXAMPLE 1

Smoking articles according to the invention are assembled by hand using bilayer combustible heat sources according to the first embodiment of the invention shown in FIG. 1 having the composition shown in Table 1. The smoking articles are assembled with the bilayer combustible heat source adjacent to and abutting the aerosol-forming substrate.

For the purposes of comparison, smoking articles of the same construction and dimensions are assembled by hand using monolayer combustible heat sources having the composition shown in Table 1.

TABLE 1

| | Bilayer combustible heat source Example 1 | Monolayer combustible heat source Comparative Example A |
|---|---|---|
| Combustible First Layer | | |
| Length (mm) | 13 | 13 |
| Diameter (mm) | 4.8 | 6.3 |
| Carbon (% by dry weight) | 65 | 45 |
| Carboxymethyl cellulose (% by dry weight) | 5 | 5 |
| Calcium peroxide (% by dry weight) | 30 | 50 |
| Second Layer | | |
| Length (mm) | 13 | — |
| Inner Diameter (mm) | 4.8 | — |
| Outer Diameter (mm) | 6.3 | — |
| Carbon (% by dry weight) | 45 | — |
| Carboxymethyl cellulose (% by dry weight) | 5 | — |
| Calcium peroxide (% by dry weight) | 50 | — |

The temperature of the aerosol-forming substrate of the smoking articles during combustion of the combustible heat sources is measured using a thermocouple attached to the surface of the smoking articles at a position 2 mm downstream of the combustible heat source. The results are shown in FIG. 3*a*.

The absorbance of the aerosol generated during each puff of the smoking articles is measured using a UV-Visible optical spectrometer with an optical cell set up to record data in the Near UV region at 320 nm. The results, which are indicative of the density of the aerosol generated, are shown in FIG. 3*b*.

To generate the profiles shown in FIGS. 3*a* and 3*b*, the combustible heat sources of the smoking articles are ignited using a conventional yellow flame lighter. Puffs of 55 ml (puff volume) are then taken in 2 seconds (puff duration) every 30 seconds (puff frequency) using a smoking machine.

As shown in FIG. 3*a*, during early puffs the temperature of the aerosol-forming substrate of the smoking article according to the invention comprising the bilayer combustible heat source according to the invention is similar to the temperature of the aerosol-forming substrate smoking article comprising a monolayer heat source having the same composition as the second layer of the bilayer combustible heat source according to the invention.

As also shown in FIG. 3*a*, during later puffs the temperature of the aerosol-forming substrate of the smoking article according to the invention comprising the bilayer combustible heat source according to the invention is significantly greater than the temperature of the smoking article comprising a monolayer heat source having the same composition as the second layer of the bilayer combustible heat source according to the invention.

EXAMPLES 2 AND 3

Smoking articles according to invention are assembled by hand using trilayer combustible heat sources according to the second embodiment of the invention shown in FIG. 2 having the compositions shown in Table 2. The smoking articles are assembled with the third layer of the bilayer combustible heat source adjacent to and abutting the aerosol-forming substrate.

The temperature of the aerosol-forming substrate of the smoking articles during combustion of the trilayer combustible heat sources is measured using a thermocouple attached to the surface of the smoking articles at a position 2 mm downstream of the trilayer combustible heat source. The results are shown in FIG. 4*a*.

The absorbance of the aerosol generated during each puff of the smoking articles is measured using a UV-Visible optical spectrometer with an optical cell set up to record data in the Near UV region at 320 nm. The results, which are indicative of the density of the aerosol generated, are shown in FIG. 4*b*.

To generate the profiles shown in FIGS. 4*a* and 4*b*, the trilayer combustible heat sources of the smoking articles are ignited using a conventional yellow flame lighter. Puffs of 55 ml (puff volume) are then taken in 2 seconds (puff duration) every 30 seconds (puff frequency) using a smoking machine.

As shown in FIG. 4*a*, the temperature of the aerosol-forming substrate of the smoking articles according to the invention comprising trilayer combustible heat sources according to the invention is substantially constant during both early puffs and later puffs.

TABLE 2

| | Trilayer combustible heat sources | |
|---|---|---|
| | Example 2 | Example 3 |
| Combustible First Layer | | |
| Length (mm) | 10 | 10 |
| Inner Diameter (mm) | 4 | 4 |
| Outer Diameter (mm) | 7.8 | 7.8 |

TABLE 2-continued

| | Trilayer combustible heat sources | |
|---|---|---|
| | Example 2 | Example 3 |
| Carbon (% by dry weight) | 65 | 65 |
| Carboxymethyl cellulose (% by dry weight) | 5 | 5 |
| Calcium peroxide (% by dry weight) | 30 | 30 |
| Second Layer | | |
| Length (mm) | 10 | 10 |
| Diameter (mm) | 4 | 4 |
| Carbon (% by dry weight) | 45 | 45 |
| Carboxymethyl cellulose (% by dry weight) | 5 | 5 |
| Calcium peroxide (% by dry weight) | 50 | 50 |
| Third Layer | | |
| Length (mm) | 3 | 3 |
| Diameter (mm) | 7.8 | 7.8 |
| Carbon (% by dry weight) | 45 | 15 |
| Graphite (% by dry weight) | — | 20 |
| Carboxymethyl cellulose (% by dry weight) | 5 | 5 |
| Calcium peroxide (% by dry weight) | 50 | 60 |

The embodiments and examples described above illustrate but do not limit the invention. Other embodiments of the invention may be made without departing from the spirit and scope thereof, and it is to be understood that the specific embodiments and examples described herein are not limiting.

In particular, while the invention has been illustrated above by reference to embodiments and examples describing bilayer and trilayer combustible heat sources, it will be appreciated that multilayer combustible heat sources according to the invention comprising four or more layers may also be produced.

The invention claimed is:

1. A multilayer combustible heat source for a smoking article, comprising:

a combustible first layer comprising carbon; and a second layer in direct contact with the first layer, the second layer comprising carbon and at least one ignition aid, wherein the first layer and the second layer are longitudinal non-fibrous concentric layers, wherein the first layer and the second layer each have an apparent density of at least 0.6 g/cm$^3$, wherein the second layer has an ignition aid content of at least 35 percent by dry weight, and wherein a composition of the first layer is different from a composition of the second layer.

2. The multilayer combustible heat source according to claim 1, wherein the first layer and the second layer have a density of between 0.6 g/cm$^3$ and about 1.0 g/cm$^3$.

3. The multilayer combustible heat source according to claim 1, wherein the apparent density of the first layer is different from the apparent density of the second layer, and wherein the difference in the apparent density of the first layer and the apparent density of the second layer is less than or equal to 0.2 g/cm$^3$.

4. The multilayer combustible heat source according to claim 1, wherein the first layer further comprises at least one ignition aid, wherein the at least one ignition aid of the first layer does not include alkali metal salts of carboxylic acids.

5. The multilayer combustible heat source according to claim 4, wherein the ratio by dry weight of carbon to ignition aid in the first layer is different from the ratio by dry weight of carbon to ignition aid in the second layer.

6. The multilayer combustible heat source according to claim 5, wherein the ratio by dry weight of carbon to ignition aid in the first layer is greater than the ratio by dry weight of carbon to ignition aid in the second layer.

7. The multilayer combustible heat source according to claim 1, wherein the first layer is an outer layer and the second layer is an inner layer circumscribed by the first layer.

8. The multilayer combustible heat source according to claim 1, further comprising:

a third layer disposed at an end of the first and the second layers, and comprising one or both of carbon and at least one ignition aid, wherein the at least one ignition aid of the third layer does not include alkali metal salts of carboxylic acids.

9. The multilayer combustible heat source according to claim 8, wherein the composition of the third layer is different from the composition of the first layer.

10. The multilayer combustible heat source according to claim 8, wherein the composition of the third layer is different from the composition of the second layer.

11. The multilayer combustible heat source according to claim 8, wherein the composition of the third layer is the same as the composition of the second layer.

12. A smoking article, comprising:

a multilayer combustible heat source according to claim 1; and an aerosol-forming substrate downstream of the multilayer combustible heat source.

13. A multilayer combustible heat source for a smoking article, comprising:

a combustible first layer comprising carbon; and a second layer in direct contact with the first layer, the second layer comprising carbon and at least one peroxide or superoxide that actively evolves oxygen at a temperature of less than 600° C., wherein the first layer and the second layer are longitudinal non-fibrous concentric layers, wherein the first layer and the second layer each have an apparent density of at least 0.6 g/cm$^3$, wherein the second layer has a peroxide or superoxide content of at least 35 percent by dry weight, and wherein a composition of the first layer is different from a composition of the second layer.

14. The multilayer combustible heat source according to claim 1, wherein the second layer has a carbon content of less than or equal to 35 percent by dry weight.

* * * * *